US007721670B2

(12) United States Patent
Weber

(10) Patent No.: US 7,721,670 B2
(45) Date of Patent: May 25, 2010

(54) KAYAK HAVING DECK FAIRING

(76) Inventor: David Weber, 934 S. McClelland St., Salt Lake City, UT (US) 84105

( * ) Notice: Subject to any disclaimer, the term of this patent is extended or adjusted under 35 U.S.C. 154(b) by 0 days.

(21) Appl. No.: 11/871,918

(22) Filed: Oct. 12, 2007

(65) Prior Publication Data

US 2008/0098945 A1 May 1, 2008

Related U.S. Application Data

(60) Provisional application No. 60/863,519, filed on Oct. 30, 2006.

(51) Int. Cl.

| | |
|---|---|
| ***B63B 35/00*** | (2006.01) |
| ***B63B 35/71*** | (2006.01) |
| *B63B 17/00* | (2006.01) |
| *B63B 7/04* | (2006.01) |
| *B63B 3/00* | (2006.01) |

(52) U.S. Cl. ..... 114/347; 114/343; 114/352; 114/355; 114/363; 114/364

(58) Field of Classification Search ..... 114/347, 114/343, 352, 355, 363, 364
See application file for complete search history.

(56) References Cited

U.S. PATENT DOCUMENTS

| | | | | |
|---|---|---|---|---|
| 883,588 | A | 3/1908 | Thatcher | |
| 2,873,459 | A | 2/1959 | März | |
| 2,999,253 | A * | 9/1961 | Lewis | 114/347 |
| 3,679,058 | A * | 7/1972 | Smith | 210/242.4 |
| 4,589,365 | A | 5/1986 | Masters | |
| 4,838,196 | A | 6/1989 | Ingram | |
| D317,748 | S | 6/1991 | Arcouette | |
| 5,076,194 | A * | 12/1991 | Curtis et al. | 114/347 |
| D341,351 | S | 11/1993 | Arcouette | |
| D352,689 | S | 11/1994 | Niemier | |
| 5,417,179 | A * | 5/1995 | Niemier et al. | 114/347 |
| D364,139 | S | 11/1995 | Niemier | |
| D364,599 | S | 11/1995 | Bartonx | |
| 5,493,982 | A * | 2/1996 | Carpenter et al. | 114/347 |
| 5,542,369 | A | 8/1996 | Ingram | |
| D377,473 | S | 1/1997 | Niemier | |
| D385,528 | S | 10/1997 | Cronin | |
| D390,527 | S | 2/1998 | Niemier | |
| D391,916 | S | 3/1998 | Masters | |
| 5,964,177 | A | 10/1999 | Niemier | |
| 5,988,098 | A * | 11/1999 | Hillhouse | 114/347 |
| 6,035,799 | A | 3/2000 | Lukanovich et al. | |
| 6,112,692 | A | 9/2000 | Lekhtman | |
| 6,152,063 | A | 11/2000 | Niemier | |
| 6,178,912 | B1 | 1/2001 | Niemier | |
| 6,223,677 | B1 | 5/2001 | Hall et al. | |
| 6,223,678 | B1 * | 5/2001 | Haller et al. | 114/347 |
| 6,263,827 | B1 | 7/2001 | Szigeti | |

(Continued)

*Primary Examiner*—Daniel V Venne
(74) *Attorney, Agent, or Firm*—Bateman IP Law Group

(57) ABSTRACT

An improved kayak provides a rigid open cockpit hull with air chambers attached to the hull. The air chambers provide a generally convex shape for increased maneuverability and also provide cushioning against impact to reduce the risk of injury to the kayak pilot. The air chambers allow for an open cockpit kayak with an exterior surface having a similar shape as a conventional closed cockpit kayak, providing a similar level of maneuverability and allowing for completion of maneuvers such as rolling the kayak from an inverted position in the water.

9 Claims, 6 Drawing Sheets

U.S. PATENT DOCUMENTS

| | | | | |
|---|---|---|---|---|
| 6,343,562 | B1 | 2/2002 | Ingram | |
| 6,443,089 | B1 | 9/2002 | Goucher | |
| 6,539,889 | B2 | 4/2003 | Simpson | |
| 6,739,278 | B2 * | 5/2004 | Callahan | 114/353 |
| 6,860,223 | B2 * | 3/2005 | Lee et al. | 114/364 |
| 6,863,014 | B2 | 3/2005 | Hudson et al. | |
| 6,880,481 | B2 | 4/2005 | Dunn et al. | |
| 7,021,233 | B2 | 4/2006 | Hall et al. | |
| 7,021,234 | B1 | 4/2006 | Belyeu | |
| 2002/0109251 | A1 | 8/2002 | Sellepack | |
| 2002/0109256 | A1 | 8/2002 | Sellepack | |

* cited by examiner

KAYAK HAVING DECK FAIRING

RELATED APPLICATIONS

The present application claims the benefit of U.S. Provisional Patent Application Ser. No. 60/863,519, filed Oct. 30, 2006, which is incorporated herein in its entirety.

BACKGROUND OF THE INVENTION

1. The Field of the Invention

The present invention relates to kayaks. More specifically, the present invention relates to an open cockpit kayak having inflatable (or air filled) sections forming sections of the upper surface of the kayak.

2. State of the Art

Kayaks are available in various different designs, such as closed cockpit and open cockpit designs. FIG. 1 shows a typical whitewater kayak 10. When referring to whitewater kayaks 10, we refer to a boat which has a design optimized for whitewater navigation. Whitewater kayaks 10 are typically of rotomolded plastic or composite construction, and the user typically sits inside the hull of the kayak such that the kayak encloses the legs of the user. The user typically wears a spray skirt 26 made of neoprene, nylon or similar material which surrounds the user's torso and is affixed around the coaming 22 (a raised rim) of the kayak cockpit 18 to seal out water.

The upper surface 14 of a closed cockpit kayak 10 is enclosed except for a cockpit opening 18 at the seat. The user sits in the kayak hull with their legs enclosed within the kayak 10 and their torso extending from the opening 18 in the upper surface 14. Whitewater kayaks 10 are highly maneuverable kayaks, and the enclosed upper surface 14 allows a person to roll the kayak more easily if inverted in the water.

Whitewater kayaks 10, however, require additional skill as a person can not exit the kayak easily and quickly in case of an emergency. The failure to exit a whitewater kayak 10 in the event of being pinned against an obstacle, broaching, or the failure to roll upright can result in serious injury and/or death. In order to exit a whitewater kayak 10, the user must have a free hand to pull the grab-loop of his/her spray skirt 26 to remove the spray skirt. The user may not always have a free hand available, especially if the user is already using both hands to steady themselves or keep their head above water. It is also possible for a kayaker to be stuck in a position which does not give them immediate access to the grab-loop, such as having their torso pinned against the stern deck. Should removal of the skirt 26 prove to be impossible, exit can be extremely difficult.

Egress of a whitewater kayak 10 typically requires: 1) a free hand to pull the spray skirt grab-loop, 2) removal of the spray skirt 26, 3) removal of the user's lower limbs from within the kayak hull, 4) the user having "clean" gear (such as bare feet, socks or booties that don't have laces, straps, buckles, etc.) that won't get caught on foot pegs, outfitting or hardware inside the kayak 10 and thus prevent the user from exiting the kayak.

Egress typically results in the flooding/swamping of the kayak 10 and an increased weight/momentum/wetted surface area of the kayak which increase the hazards and difficulties associated with recovery of the kayak in moving water. A swamped kayak as such also poses greater danger to those downstream from it in moving water.

Even when a kayaker is successful at exiting the kayak 10, further complications arise, such as the kayak filling with water which must be drained in order for the kayak to be operable again. This generally requires the recovery of the kayak 10 which can be difficult since such swamped kayaks tend to be much heavier than un-swamped kayaks. A swamped kayak 10 is also more likely to become pinned on rocks and require mechanical advantage to un-pin. An additional hazard is posed by the increased weight and momentum of a swamped kayak 10, as the kayak can be dangerous if the user is downstream of the swamped kayak and becomes caught between the kayak and a rock or obstruction in the river.

After egress a user must typically perform the following steps required to resume paddling and use of the kayak 10: 1) the kayak 10 must be recovered, possibly requiring a high degree of strength or leverage to un-pin the kayak, 2) the kayak must be drained, generally requiring a somewhat dry, level surface, and 3) the user must re-enter the kayak and re-secure the spray skirt 26, which is also fairly difficult without access to a dry, level surface.

Unintentional egress of the kayak 10 can also be caused by the failure of the spray skirt 26 when water pressure builds on it in areas such as the base of waterfalls. Water pressure may build on the skirt 26 to the point where it fails, forcing unintentional egress. This typically happens in jump hydraulics (commonly referred to as "holes"), upon landing from waterfalls or any situation where sufficient pressure forms on the skirt 26.

Because of the confined nature of typical whitewater kayak 10 designs, special low-profile gear must be used on the feet and legs which avoids shoelaces, straps, buckles and other loose components which might get caught in the internal outfitting of the kayak and thus prevent the kayaker from exiting. Such gear, while a necessity for safe use of the kayak 10, is usually poorly suited to hiking and traversing the rocky and rough terrain which is typically found around whitewater rivers, and recovery of the kayak 10 typically requires such hiking. After the kayak 10 has been recovered, it must be drained of water which typically requires moving the kayak to the river bank to provide a solid surface on which to manipulate the boat. Some rivers do not always have easily accessible banks either due to the extreme width of the river, the steep angle of the banks (such as sheer canyon walls), heavy vegetation overgrowth, etc.

Kayaks 10 pose additional dangers. A person can easily hit their head or body on the rigid upper surface 14 of the kayak 10 as they reenter the water after passing over a waterfall or are otherwise tossed about by the water or as they bump into the rocks. Whitewater kayaking involves the navigation of rivers and streams with high gradient, occasionally requiring the user to cross waterfalls, ledges and other drops which involve a period of freefall and subsequent impact upon landing. The whitewater kayak 10 does little to absorb or transfer the energy produced in such drops away from the boater. Injuries commonly result from these impacts in the form of broken ankles, legs and other bodily harm resulting from the full weight and momentum of the kayaker being transferred to the lower limbs.

Additionally, the upper body is subject to injuries resulting in the abrupt impact with the hard plastic deck or cockpit coaming 22. Injuries typical to such impact include broken ribs, broken nose, jaw and tooth injuries, concussion, broken back, etc. If a person goes over a waterfall in a kayak, the kayak points downwardly as it enters the water, often causing the person to hit their head or body on the upper kayak surface 14 as the kayak reenters the water and decelerates from the drop. The person may also injure their feet, legs, and lower body as the force of impact is transferred through the kayak 10 without mitigation. A person may also become trapped in a kayak if the kayak shell becomes collapsed due to water pressure, a collision with a rock, etc.

The inclusion of the cockpit opening 18 in a whitewater kayak 10 poses a structural problem, as it reduces the structural rigidity of the kayak 10 along the length thereof. This frequently leads to kayaks 10 folding across the cockpit area during a broach and pin situation. This structural problem tends to be amplified when the spray skirt 26 is removed and the kayak 10 is allowed to fill with water. Thus, kayakers are frequently forced to keep their spray skirts 26 secured in such situations in order to prevent the kayak 10 from folding and collapsing onto their legs. Exiting a folded kayak 10 is difficult if not impossible without significant force or mechanical advantage. This situation is referred to as "deck entrapment" by whitewater kayakers.

The open cockpit 18 is also disadvantageous as the hull of the kayak 10 is open unless sealed by the skirt 26, creating the potential for rapid flooding and swamping of the kayak which significantly decreases the kayaks buoyancy. Thus, the design of whitewater kayaks 10 results in some significant dangers.

Sit-on-top kayaks 30, as shown in FIG. 2, have been made which have a sealed hull and a generally open seating area in the upper surface 34. The upper surface 34 includes an extensive recess 38 in which a person sits to pilot the kayak 30. The recess 38 typically includes a seat portion 42 and channels for the pilot's legs and feet 46. Thus, in a sit-on-top kayak 30, a significant amount of the upper surface 34 of the kayak is concave where the upper surface of a closed cockpit kayak 10 (FIG. 1) is convex.

Sit-on-top kayaks 30 are typically optimized for flat, calm water (Class I or lower navigation). The hull is watertight for the most part and the user typically sits inside of a depression or recess 38 formed on the deck of the boat which has been designed to act as a seat and foot holds. Further security and control can be provided to the user by the addition of thigh straps which go around the legs of the boater. While the Sit-on-top design addresses some of the problems mentioned above, such as providing easier egress from the kayak, it does not address all of them and presents new ones as well. For example, sit-on-top kayaks are not well suited for whitewater use.

Sit-on-top kayaks 30 have inherent performance problems. The concave nature of the deck 34 acts as a basin and can trap water, decreasing the buoyancy of the kayak until the water can be drained. This draining is usually accomplished by the addition of drain holes in the bottom of the recess 38 (sometimes called a "self-bailing" design). It will be appreciated, however, that even a kayak which drains in seconds can quickly become un-maneuverable on a river where water is coming constantly over the deck, as may be a common situation in whitewater usage. This concavity also adversely affects the resurfacing characteristics of the boat after it has been partially or fully submerged, such as when the boat goes through a hydraulic jump or submerges after landing from a drop.

The deck profile of sit-on-top kayaks 30 also adversely affects the kayaker's ability to self-rescue, which is typically accomplished using a skill known as an "Eskimo Roll" or simply a "roll". The roll is accomplished when the kayaker positions themselves underwater to pull a stroke perpendicular to the kayak, essentially pulling themselves up from out of the water and back into an upright position. If we imagine a line running through the central axis of a kayak from the bow end to the stern end, we might call this the "long axis" of the kayak. In a conventional kayak, this imaginary "long axis" runs through the body (pelvis) of the kayaker, close to the kayaker's center-of-gravity. In a SOT kayak, this axis runs below the kayaker's body, much further away from the kayaker's center-of-gravity. The closer a kayaker's center-of-gravity is to the long axis of the kayak, the easier the kayak is to roll.

Something similar to this can be observed in figure skating when the skater performs a spin. The closer the skater pulls their limbs in to the axis of their rotation, the faster they spin. Similarly, the more they open up the slower they spin. The lower ability to roll a sit-on-top kayak 30 combined with the relatively insecure seating position, poor water-shedding characteristics, and non-streamlined cross-section profile of the deck make sit-on-top kayaks considerably more difficult to roll than conventional whitewater kayaks.

Finally, the characteristics which make sit-on-top kayaks 30 so easily escapable also make it difficult for the boater to remain seated on the kayak and in control when navigating the violent currents associated with whitewater.

Thus, the concave upper surface 34 of a sit-on-top kayak 30 makes the kayak less maneuverable in certain situations, such as rolling the kayak upright when inverted in the water. Additionally, a person may still hit their head or body on the upper surface 34 of an open kayak 30 if they are tossed about by the water or collisions with rocks.

Some inflatable sit-on-top kayaks have been made in a shape similar to rigid sit-on-top kayaks. These inflatable kayaks, however, are frequently more difficult to navigate as the inflatable hull does not maneuver through the water as crisply as a rigid hull. An inflatable hull is less rigid, and may therefore lose maneuverability as compared to other types of kayaks.

There is thus a need for a kayak which overcomes the limitations of available kayaks. Specifically, there is a need for a kayak which achieves the maneuverability of a rigid closed cockpit kayak without the difficulties and dangers associated therewith. There is need for a kayak which may be more easily mounted and dismounted by a person, which is highly maneuverable in the water, and which reduces the risk of injury caused by a person hitting their head or body on the upper kayak surface while using the kayak.

SUMMARY OF THE INVENTION

It is an object of the present invention to provide an improved kayak. The inventive kayak allows the user to sit inside a depression molded into the deck of the hull, and the deck profile is filled and streamlined using foam or inflatable inserts that also provide protection and energy absorption in the event of an impact.

According to one aspect of the invention, a kayak is provided with a generally rigid closed hull having inflatable or partially inflatable or air filled inserts which may be placed into a recess formed in the hull. The inserts allow for control of the shape of the kayak. The kayak may be provided with an upper surface shape which is similar to that of a sit-on-top kayak, providing the maneuverability of the whitewater kayak. The shape of the insert makes the kayak easier to roll, for example. Additionally, the inserts allow for a kayak in which a person sits on top of the kayak and is not enclosed in the kayak hull, but where the upper surface of the kayak is maintained as a generally convex surface similar to a whitewater kayak.

According to another aspect of the invention, a safer kayak is provided. The use of inserts provides softer areas around the pilot, cushioning any contact between the pilot and the kayak. The use of a rigid lower hull maintains the maneuverability of the kayak.

The present invention provides an inflatable hybrid kayak. The kayak design is a composite structure craft as it utilizes multiple materials of differing physical qualities to compose the main structure. The kayak may typically use a rotomolded polyethylene plastic in the hull for strength and durability, foam in the deck fairing to provide energy absorption in an impact and an inflated air bladder in the stern fairing for impact protection and to provide an air reserve in the case of an emergency.

The kayak typically consists of the following components: The kayak includes a rotomolded, plastic, or composite material (i.e. fiberglass/resin) hull which is constructed similarly to a sit-on-top kayak with depressions or cavities molded into the deck which accept the other components.

The kayak also typically includes a series of foam or inflatable components which fit into the cavities of the hull deck and in turn leave cavities which the boater can situate themselves within. These are typically foam or inflatable bladders depending on the specific engineering requirements of the particular kayak design. These components are fairings as they create a streamlined, water-shedding, convex deck profile above the deck of the hull that reduces drag and provides protection.

The kayak also typically includes the various straps and outfitting necessary to attach the fairing to the hull, a seat, and a pair of thigh-straps to secure the user within the kayak.

These and other aspects of the present invention are realized in a kayak as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims. For clarity, not all structures are shown or discussed in each figure.

Figure 3:
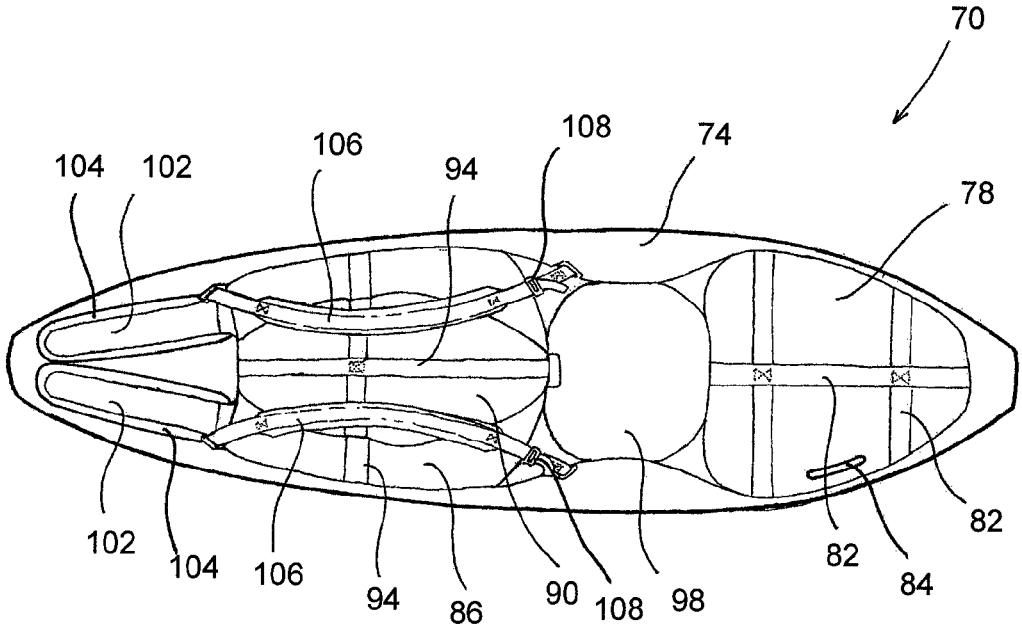
FIG. 3 shows a top view of a kayak of the present invention.

Turning now to FIG. 3, a top view of a kayak 70 according to the present invention is shown. The kayak 70 includes a generally rigid hull 74. The rigid hull is advantageous as it creates a kayak 70 which is generally more maneuverable than an inflatable kayak. The kayak 70 allows the pilot to sit on top of the kayak 70 rather than being enclosed in the kayak. In order to eliminate limitations found in existing sit-on-top kayaks, the kayak 70 includes various additional features.

The kayak 70 could be said to have two decks, one formed by the upper surface of the plastic hull which is basically concave and into which the fairing is seated, and one formed by the upper surface of the fairing which is basically convex. Though the fairing can be removed, the kayak is not intended to be operated in whitewater without those components installed. The secondary (lower) deck acts as more of a horizontal bulkhead in practice than a deck per se. Thus, the kayak may be thought of as having a primary (convex foam) and a secondary (concave plastic) deck.

A rear air chamber 78, or stern fairing, is disposed behind the pilot. A recess is preferably formed in the kayak 70 to receive the rear air chamber 78, and straps 82 are typically used to secure the rear air chamber to the kayak. The kayak deck cavity (recesses 118, 122, 126, 130, FIG. 5) is designed to accept an inflatable air bladder or a foam block in the stern. This rear air chamber 78 provides protection to the user's head and torso in the event of an impact in which the boater's head and torso might be thrown onto or against the stern of the boat. Although the rear air chamber could also be formed as a foam cushion, the advantage of using an air bladder over foam would be to provide the user with an air reserve that could be used in an emergency. Thus, a port or tube 84 could be provided to allow the user to draw air from the rear air chamber 78.

It should be noted that the rear air chamber 78 and its corresponding cavity in the hull could be eliminated by providing a rear hull portion with a convex deck profile. Such a portion could also be formed to include a storage hatch or other useful features. Eliminating the air chamber 78 would not, however, provide the same measure of impact protection to the user.

A front bow fairing 86, which could be a foam block or an air chamber, is disposed in front of the pilot. The kayak hull's deck cavity is designed to accept a large foam block or inflatable bladder which fits between the boater's legs. This bow fairing 86 serves several functions. First it acts as a crush zone for the head and torso in the event of a so called "Piton" impact where the body would fold at the waist causing the user's head and torso to be thrown forward and down. Second, to a lesser extent the bow fairing would also stop the user's pelvis from sliding forward in a "Piton" impact. The bow fairing 86 also provides the bulk of the streamlining for the bow primary deck profile. It can be designed to go underneath the boater's legs or not depending on the specific design of the kayak hull.

Thus, the front air chamber 86 may have a raised center section 90 such that the pilot's legs are placed around the center section. A recess is typically formed in the kayak 70 to receive the front air chamber 86, and straps 94 are typically used to hold the front air chamber 86 to the kayak. Of course, other attachment mechanisms such as clips, clamps, bolts, etc. could also be used.

A seat 98 is provided to accommodate the pilot. The seat 98 may be molded in to the hull 74, or advantageously may be formed as a separate padded seat attached to the hull. In such a case, the hull 74 will typically have a recess formed therein for receiving the seat 98. The seat 98 may be formed of foam or expanded plastic for comfort. If constructed of foam, the seat can be utilized to absorb energy in the event of an impact and provide further protection to the user.

The pilot's legs extend across the front air chamber 86 and the pilot's feet are placed in foot wells 102. The foot wells may be molded into the hull 74 of the kayak. Additionally, a larger recess may be formed in the hull 74, allowing an insert or foot block fairing 104 containing the foot wells 102 to be placed therein. The foot block fairing would typically be constructed of MINICEL®, EPP (expanded polypropylene) or even EPS (expanded polystyrene) material. The primary purpose of the foot block fairing 104 is to provide a point of contact for the user to control the boat. An additional purpose of the foot block fairing 104 is to provide an energy absorbing crush zone which helps reduce the likelihood of injury in the event of the boat landing on a hard surface with the bow pointed downwards, which is sometimes called Pitoning or penciling a kayak.

Straps 106 are included which are used to secure the pilot to the kayak 70. Typically, the straps 106 pass over the pilot's legs. These leg straps 106 aid in allowing a user to quickly exit the kayak. Additionally, exiting of the kayak can be accomplished hands-free. The user simply leans back and pushes off the footholds. As the user's body straightens out, the pelvis is lifted out of the seat depression while at the same time the legs straighten out, moving them free of the leg straps 106. Because the kayak does not have an open cavity and the plastic hull is relatively water-tight, the kayak does not fill with water and become swamped when the boater exits.

A pair of quick-release buckles 108 can be added to the leg straps 106 where they connect with the hull 74 right below the user's hands. When pulled, the quick release buckles 108 would release the thigh straps entirely. This would provide for an additional margin of safety and provide the added advantage of being closer to the boater's body than a spray skirt's grab-loop which is typically located by the user's knees. The quick release buckles 108 would increase the user's ability to safely exit the kayak if the user is forced into a position where their torso lies against the stern deck of the kayak. Because the user's legs are situated above the hull, there would be little if any possibility of deck entrapment per se.

Figure 1:
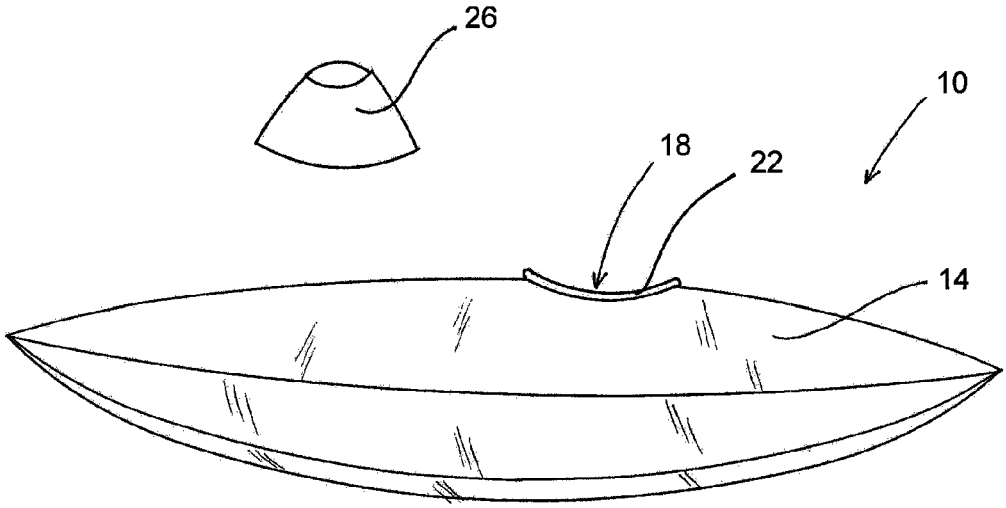
FIG. 1 Prior Art
FIG. 1 shows a side view of a kayak known in the prior art.
Figure 2:
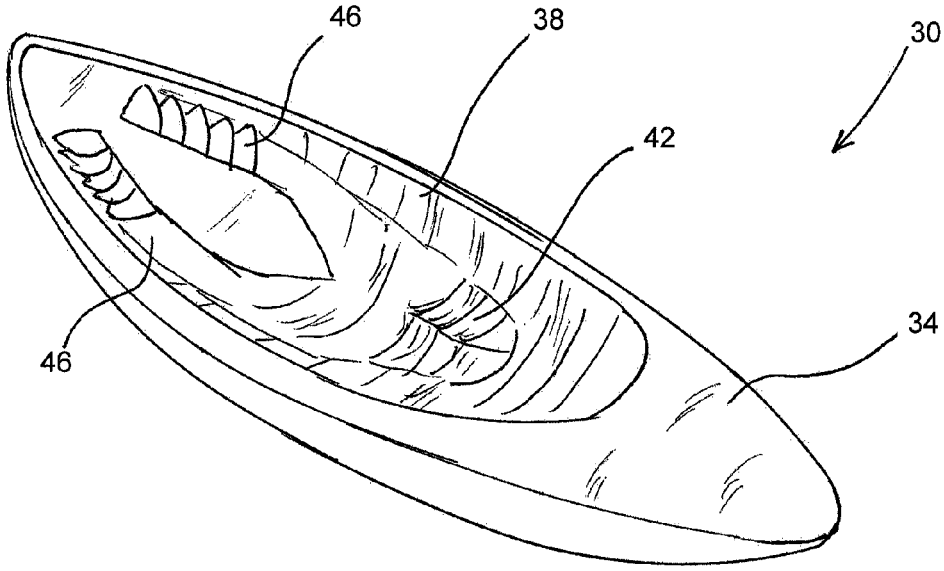
FIG. 2 Prior Art
FIG. 2 shows a perspective view of a kayak known in the prior art.
Figure 4:
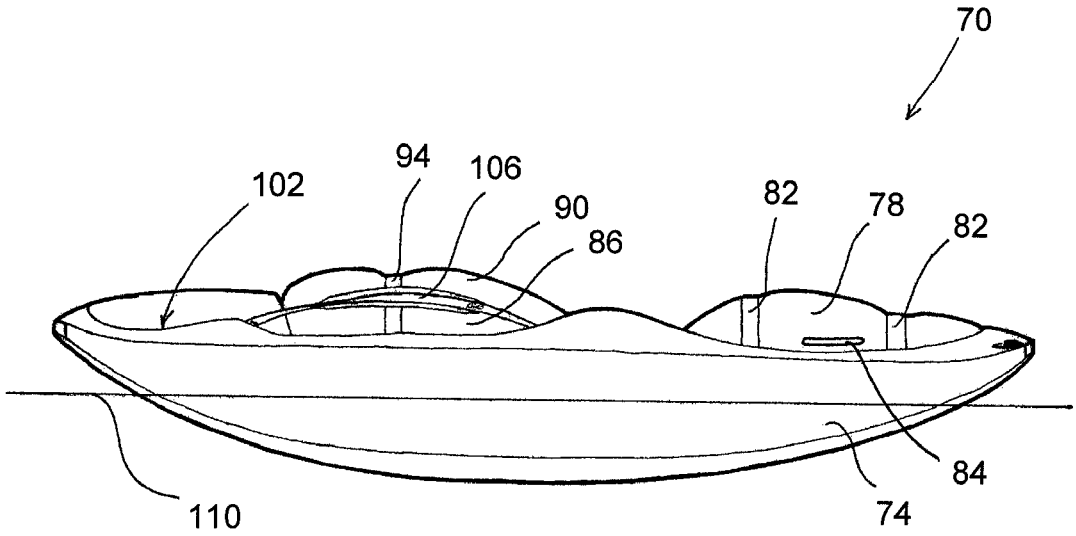
FIG. 4 shows a side view of a kayak of the present invention.

FIG. 4 shows a side view of the kayak 70. The side view illustrates how the rear air chamber 78 and the front air chamber 86 form part of the upper surface of the kayak 70. The air chambers 78, 86 form a convex surface similar to a closed cockpit kayak as shown in FIG. 1, avoiding the concave upper surface of the typically open cockpit kayak as shown in FIG. 2. Providing a convex upper surface allows for a more maneuverable kayak, allowing a pilot to more easily complete maneuvers such as rolling the kayak upright if inverted in the water. By providing a shape which is similar to that of a typical closed cockpit kayak, the present kayak achieves a similar level of maneuverability. The typical waterline is indicated at 110.

The use of the fairings (rear air chamber 78, front bow fairing 86) to fill in and streamline the deck profile (filling in the cavities which are molded into the hull) reduces drag during a roll and prevents water from completely filling the hull cavity. Since the user is seated below the primary deck lines (the top of the overall kayak), the effective "long axis" of the boat is moved up closer to the user's center of gravity. This also improves the ability to roll the kayak, as well as helping to keep the user secure within the kayak in turbulent water.

It should be noted that the fairing need not keep water from entering the kayak entirely, as the kayak may have drain holes in the hull. Rather, the fairing minimizes the amount of water which enters and remains in the hull cavities as the fairing (rear air chamber 78, front fairing 86, etc.) occupies the hull cavities and eliminates spaces where water could accumulate. Thus, the water that does enter the kayak would be drained by the use of holes in the hull, making the kayak 70 a self-bailing design. The sealed hull and generally water-tight design of the kayak prevents the kayak from filling with water and becoming swamped.

The design of the kayak 70 also has structural advantages over available kayaks. Without a discrete cockpit opening, the hull achieves greater structural strength along the length of the kayak. This may be further enhanced by the use of sidewalls surrounding the cavity or cavities formed in the hull.

As discussed, the fairings, including the air chambers or foam blocks 78, 86 also provide improved safety. When kayaking, it is not uncommon for the pilot to collide with the kayak 70. A sudden bounce or drop over a wave, collision with a rock, etc. will frequently knock the pilot into the kayak 70, often into the areas in front of or behind the pilot. When a pilot takes the kayak 70 over a waterfall the pilot may be forced against the back of the kayak as the kayak enters the water front first. Alternatively, the pilot may be forced against the front of the kayak 70 as the buoyancy of the kayak suddenly decelerates the kayak. The present invention helps eliminate injury due to collision with the kayak 70 by providing front and rear air chambers 78, 86 in front of and behind the pilot seat 98 so as to cushion a collision between the pilot and kayak.

Figure 5:
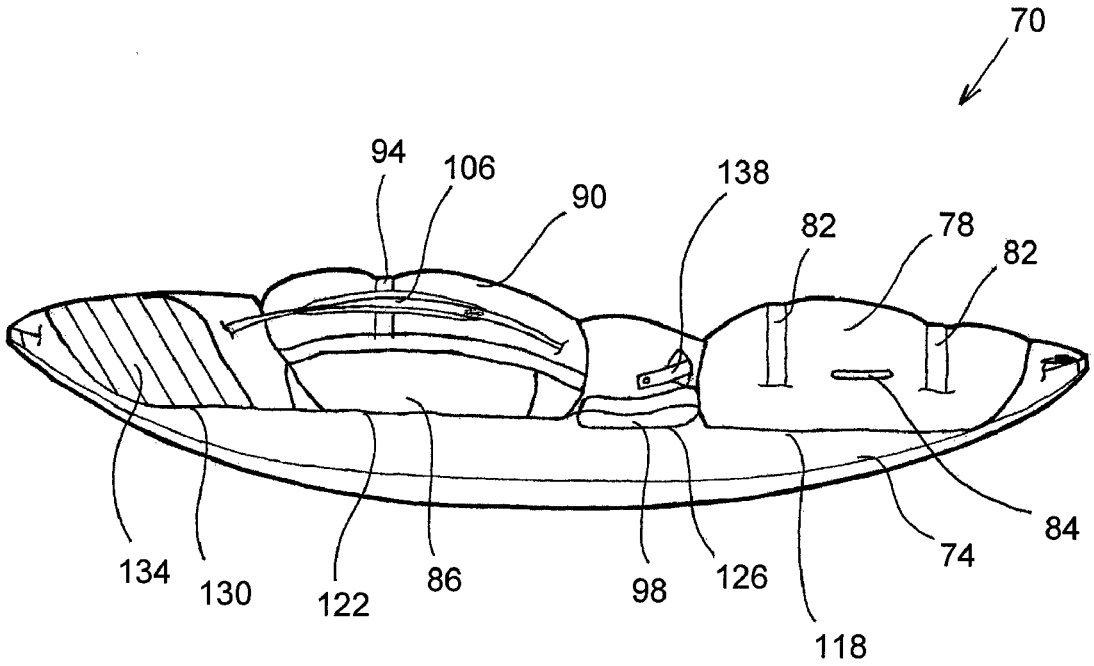
FIG. 5 shows a partial cut-away side view of a kayak of the present invention.

FIG. 5 shows a partial cut-away view of the kayak 70 of the present invention, illustrating how the air chambers 78, 86 may be fitted into the rigid hull 74. The hull 74 may have a rear recess 118 formed to receive the rear air chamber 78 and a front recess 122, seat recess 126, and foot recess 130 for receiving the front air chamber 86, seat 98, and foot insert 134, respectively. The recesses 118, 122, 126, 130 may be connected into a generally continuous recess which varies in shape and depth to accommodate the desired sizes and shapes of air chambers 78, 86, seat 98, and foot insert 134. A foot insert 134 may be used for a variety of purposes, such as forming different sizes of foot wells 102 in a standard kayak hull 74, providing a crush zone for frontal impacts, etc.

The seat 98 may include a back rest 138. The back rest may be formed as a separate structure which attaches to the hull 74. Alternatively, the back rest 138 may be formed as part of the seat 98 or rear air chamber 78. If the seat 98 is formed as an integral part of the hull 74, the back rest 138 may also be formed as part of the hull, or as a separate structure or part of the rear air chamber as discussed.

Figure 6:
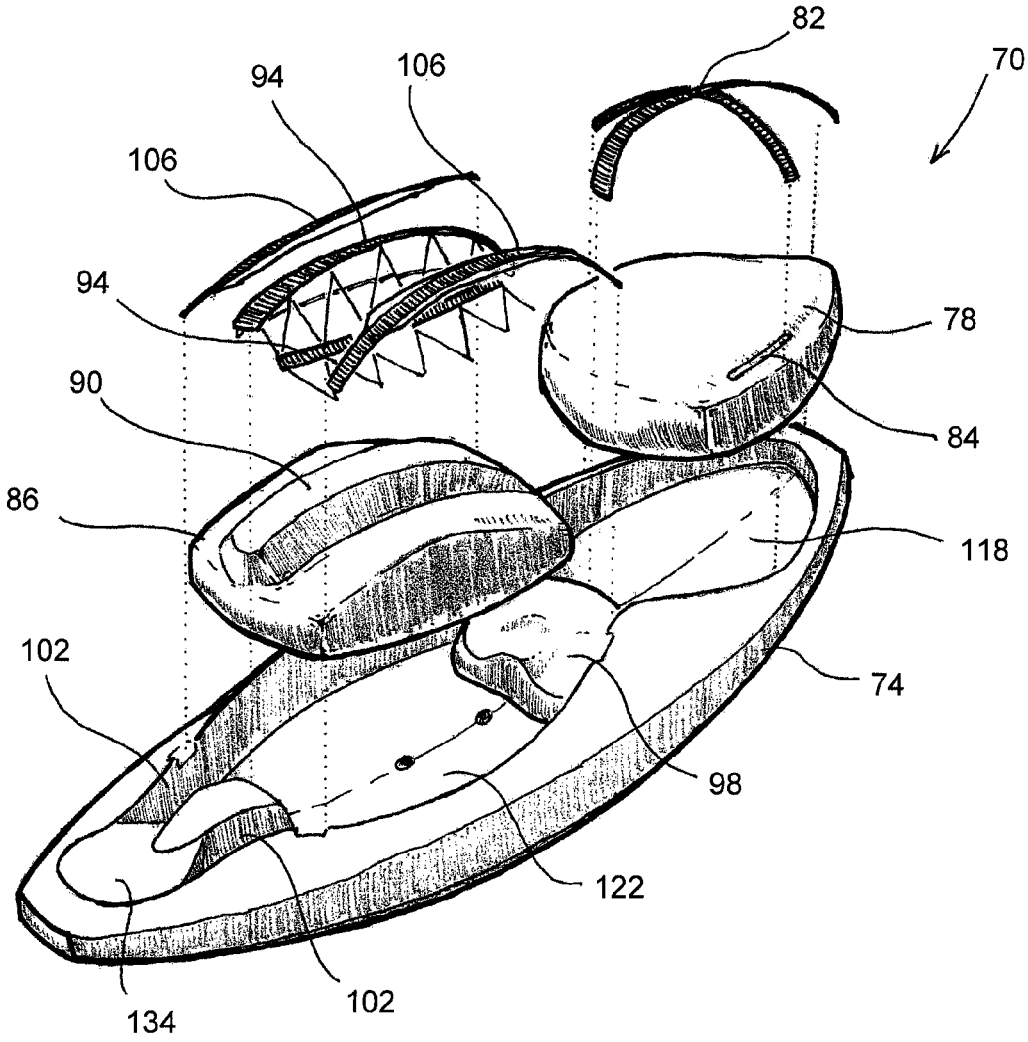
FIG. 6 shows a partially exploded perspective view of a kayak of the present invention.

FIG. 6 shows a partially exploded perspective view of the kayak 70 of the present invention. It can be more clearly seen how recesses 118, 122 can be formed in the hull 74 to receive the air chambers 78, 86, as well as the other structures. It can additionally be more easily seen how the front air chamber 86 may have a raised section 90 to form recesses for the pilot's legs.

As an additional advantage, the straps 106 used to secure the pilot's legs while using the kayak 70 may be used as shoulder straps to aid in carrying the kayak when necessary. It may periodically be necessary to carry a kayak, such as when carrying it to or from the water or carrying the kayak around a section of water which is too difficult or not navigable. The straps 106 may be used for carrying the kayak in the same configuration as they are used for using the kayak, or they may be provided with clips or adjustment mechanisms for moving the straps or otherwise making the straps more convenient for carrying the kayak.

It is thus appreciated that the kayak 70 provides several advantages. The air chambers 78, 86 provide impact cushions and also form a generally continuous and convex upper surface which increases the maneuverability of the kayak 70. The air chambers 78, 86 prevent swamping of the kayak 70. Additionally, the air chambers 78, 86 may be used to regulate the buoyancy of the kayak, or to regulate the amount of leg or back support by varying the amount of air therein. The air chambers 78, 86 may also be removable and provided in different sizes or shapes so as to allow the kayak 70 to be customized to different pilots. The air chambers as discussed may be formed as bladders, such as rubber or reinforced vinyl chambers, and are typically provided with a valve to facilitate inflation of the chambers.

The air chambers 78, 86 may be attached to the kayak with straps as shown. Alternatively, the kayak 70 may include clips or other fasteners for attaching the air chambers, or for attaching a base which connects to the air chambers. The present invention may be additionally advantageous by providing additional storage or other conveniences. The recesses 118, 122 may be made deep enough to allow for a storage container or the like to be placed below the air chambers 78, 86. A storage container may be attached below an air chamber, and may or may not be attached to the air chamber. The straps 82, 94 could be used for attaching the storage container.

The air chambers 78, 86 may be pre-filled or may be filled by the user. An air chamber which may be filled by the user will typically include a valve as discussed, and may allow the user to adjust the amount of air in the chamber while kayaking.

There is thus disclosed an improved kayak. It will be appreciated that numerous changes may be made to the present invention without departing from the scope of the claims.

What is claimed is:

1. A kayak comprising:

a rigid hull having a top and a bottom, the hull being formed from a rigid material, the top of the hull having a seating portion for allowing a user to sit thereon, the top of the hull having at least one recess therein configured for receiving a fairing, and wherein the hull is closed such that a user does not enter the hull when sitting thereon; and at least one fairing attached to the top of the hull and forming an upper surface of the kayak, the fairing being formed of an elastically compressible material and being positioned on the top of the hull such that the fairing is placed between a user seated in the seating portion and the hull so as to prevent contact between the user and the hull;

wherein the at least one fairing comprises a front fairing disposed on a front portion of the hull so as to extend beneath adjacent legs of a user and a rear fairing disposed on a rear portion of the hull so as to extend behind a user, and wherein the front fairing and rear fairing extend toward the seating portion so as to cover the hull adjacent the seating portion; and wherein the front fairing extends beneath the legs of a user so as to be between the hull and the legs of the user and wherein the front fairing has longitudinal recesses formed therein to accommodate the legs of a user.

2. The kayak of claim 1, further comprising leg straps configured for holding the legs of a user against the front fairing.

3. The kayak of claim 2, wherein the leg straps comprise quick release buckles configured for allowing a user to release the leg straps.

4. A kayak comprising:

a rigid hull having a top and a bottom, the hull being formed from a rigid material, the top of the hull having a seating portion for allowing a user to sit thereon, the top of the hull having at least one recess therein configured for receiving a fairing, and wherein the hull is closed such that a user does not enter the hull when sitting thereon; and at least one fairing attached to the top of the hull and forming an upper surface of the kayak, the fairing being formed of an elastically compressible material and being positioned on the top of the hull such that the fairing is placed between a user seated in the seating portion and the hull so as to prevent contact between the user and the hull;

wherein the at least one fairing comprises a front fairing which is disposed in front of the seating portion and which extends forward to cover an area of the hull adjacent legs of a user and which extends backward to the seating portion so as to cover the portion of the hull adjacent the front of the seating portion; and wherein the front fairing extends beneath the legs of a user so as to be between the hull and the legs of the user and wherein the front fairing has longitudinal recesses formed therein to accommodate the legs of a user.

5. A kayak comprising:

a rigid hull, the hull having a top, a bottom, and sides, the hull being formed from a rigid material, the hull being hollow and having an enclosed interior and having a seat formed on the top of the hull, the seat being formed such that a user sits on the top of the hull and is not inside of the enclosed interior of the hull; and a generally soft and compressible fairing attached to the top of the hull so as to cover a portion of the top of the hull so as to extend upwardly beyond the hull so as to define an upper contour of said portion of the top of the hull, the fairing extending to the seat so as to cover said portion of the hull adjacent the seat and prevent contact between a user and said portion of the hull; wherein the rigid hull and the fairing are shaped so that a user sitting on the seat is not enclosed by the rigid hull and the fairing, the fairing extending beneath the user's legs when the user is sitting in the seat, and wherein the fairing comprises a front fairing member which extends in front of a seat, and wherein the front fairing comprises longitudinal recesses configured for receiving the legs of a user such that the fairing is disposed between the hull and the legs of the user.

6. The kayak of claim 5, wherein the fairing extends across a majority of the top of the hull.

7. The kayak of claim 5, wherein the hull comprises a recess formed on the top side thereof and extending longitudinally across the top side, the recess configured for receiving a front fairing, a rear fairing, and a seat.

8. The kayak of claim 5, further comprising leg straps configured for securing the legs of a user to the kayak.

9. A kayak comprising:

a rigid hull having a top and a bottom, the top of the hull having a seating portion for allowing a user to sit thereon, the top of the hull having at least one recess therein configured for receiving a failing, and wherein the hull is closed such that a user does not enter the hull when sitting thereon; and at least one fairing attached to the top of the hull in the at least one recess and filling the at least one recess to form a generally convex upper surface of the kayak, the fairing being formed of an elastically compressible material and wherein the at least one fairing has longitudinal recesses formed therein configured for receiving the legs of a user.

* * * * *